US009945122B2

(12) United States Patent
Thomas

(10) Patent No.: US 9,945,122 B2
(45) Date of Patent: Apr. 17, 2018

(54) PILLAR ASSEMBLY

(71) Applicant: IGC Gate Components Inc., Kelowna (CA)

(72) Inventor: Charles Frederick Thomas, Vero Beach, FL (US)

( * ) Notice: Subject to any disclaimer, the term of this patent is extended or adjusted under 35 U.S.C. 154(b) by 72 days.

(21) Appl. No.: 15/005,778

(22) Filed: Jan. 25, 2016

(65) Prior Publication Data

US 2017/0211275 A1 Jul. 27, 2017

(51) Int. Cl.
*E04C 3/36* (2006.01)
*E04H 17/20* (2006.01)
*E04H 17/16* (2006.01)

(52) U.S. Cl.
CPC ..... *E04C 3/36* (2013.01); *E04H 17/20* (2013.01); *E04H 17/16* (2013.01)

(58) Field of Classification Search
CPC ..... E05T 2900/40; E06B 11/02; E06B 1/524; E04H 12/2253; E04H 17/20; E04H 2017/1452; E04C 3/30; E04C 3/36; E04F 13/0736
USPC ..... 52/834, 835, 844, 149, 150
See application file for complete search history.

(56) References Cited

U.S. PATENT DOCUMENTS 495,291 A * 4/1893 Barnes ..... E06B 11/04 49/160
611,568 A * 9/1898 Dohme ..... E06B 1/524 256/41
1,234,893 A * 7/1917 Fridley ..... E04H 12/2269 384/126
1,237,837 A * 8/1917 Sundh ..... E04H 17/063 256/1
1,537,420 A * 5/1925 Doddridge ..... E05D 7/043 16/236
1,540,490 A * 6/1925 Mertel ..... E06B 11/04 49/381
1,794,467 A * 3/1931 Lucas ..... F21V 33/006 256/33
2,647,593 A * 8/1953 Holman ..... E04H 12/2215 52/114
2,690,326 A * 9/1954 Kranick ..... E04H 17/08 256/21
3,413,775 A * 12/1968 Katz ..... E04F 13/0885 52/254
3,799,506 A * 3/1974 Schwartz ..... E04H 17/1408 256/24
4,218,858 A * 8/1980 Legler ..... E02D 5/805 52/165
4,242,822 A * 1/1981 Black ..... G09F 7/18 248/156
4,455,795 A * 6/1984 Cole ..... E04H 12/2215 52/155
4,467,584 A * 8/1984 Crites ..... E04F 13/0805 52/489.1

(Continued)

*Primary Examiner* — James M Ference
(74) *Attorney, Agent, or Firm* — David H. Chervitz

(57) ABSTRACT

A pillar assembly has a first side member, a second side member for connecting to the first side member, a third side member having a first side channel, a second side channel, and an access opening, the third side member for connecting to the second side member, and a fourth side member having an adjustment opening, the fourth side member for connecting to the first side member and the third side member. A pillar assembly having a reinforcing member is also disclosed.

14 Claims, 7 Drawing Sheets

(56) References Cited

U.S. PATENT DOCUMENTS 4,543,757 A * 10/1985 Cosgrove ..... E02D 27/42 248/158
4,603,520 A * 8/1986 Deike ..... E04H 17/08 52/157
4,665,650 A * 5/1987 Hall ..... E05F 1/066 49/280
4,686,807 A * 8/1987 Newsome ..... F24B 1/18 110/184
4,703,600 A * 11/1987 Suh ..... E04C 1/39 52/437
4,811,534 A * 3/1989 Newsome ..... F24B 1/18 285/42
4,815,713 A * 3/1989 Schmanski ..... E04H 17/08 248/156
4,858,876 A * 8/1989 Moreno ..... E04H 12/2223 248/156
4,874,149 A * 10/1989 Miceli ..... E04H 12/2215 248/156
4,923,164 A * 5/1990 Stenberg ..... E04H 12/2215 248/156
4,930,752 A * 6/1990 Wolper, Jr. ..... E01D 19/103 256/13.1
4,995,590 A * 2/1991 Close ..... E04H 17/1434 256/23
5,035,082 A * 7/1991 Butler ..... E01F 13/06 49/334
5,050,828 A * 9/1991 Wolff ..... E04H 12/2215 248/156
5,123,623 A * 6/1992 McNamara ..... E04H 12/2253 248/156
5,133,164 A * 7/1992 Legler ..... E04H 12/2261 52/165
5,197,248 A * 3/1993 Kruse ..... E04H 17/1421 52/309.12
5,203,817 A * 4/1993 Klumpjan ..... E04H 12/2276 256/19
5,335,471 A * 8/1994 Kupiec ..... E01F 15/003 248/218.4
5,359,827 A * 11/1994 Gehman ..... E04H 12/2238 256/DIG. 5
5,373,664 A * 12/1994 Butler ..... E01F 13/06 49/25
5,625,988 A * 5/1997 Killick ..... E01F 9/685 248/156
5,725,201 A * 3/1998 Parth ..... E04C 2/20 160/235
5,901,525 A * 5/1999 Doeringer ..... E02D 27/42 248/519
5,934,035 A * 8/1999 Rasmussen ..... E04C 1/395 256/19
5,956,920 A * 9/1999 Davis ..... E04C 3/30 52/236.1
5,960,601 A * 10/1999 Offutt ..... E04H 17/20 256/1
6,244,221 B1 * 6/2001 Kleinsasser ..... A01K 1/0017 119/524
6,401,411 B1 * 6/2002 Maglio, Jr. ..... E02D 27/42 52/101
6,409,419 B1 * 6/2002 Hernandez ..... E01F 13/04 404/6
6,611,992 B1 * 9/2003 Arnaud ..... E05F 1/068 16/239
6,886,296 B1 * 5/2005 John ..... E04H 12/2292 248/519
7,155,779 B2 * 1/2007 Watkins ..... E05F 15/54 16/316
7,191,573 B1 * 3/2007 Newton, II ..... E04H 12/2253 52/170
7,243,473 B2 * 7/2007 Terrels ..... E04C 3/30 52/843
7,325,790 B2 * 2/2008 Lee ..... E04H 12/2269 256/65.14
7,367,161 B1 * 5/2008 Jones ..... E02F 15/614 49/334
7,866,120 B2 * 1/2011 Prenn ..... E01F 15/141 52/169.13
7,988,035 B2 * 8/2011 Cox ..... A47G 29/1209 232/39
8,015,775 B2 * 9/2011 McMullen ..... E04C 3/32 52/170
8,375,517 B1 * 2/2013 Johnsen ..... E05D 7/0027 16/236
8,534,005 B2 9/2013 Thomas et al.
8,966,713 B1 * 3/2015 Russo ..... E05F 1/10 16/285
9,133,625 B2 * 9/2015 Mingyong
9,518,424 B1 * 12/2016 Woodard ..... E04H 17/22
2001/0022056 A1 * 9/2001 Gifford ..... E04F 13/0736 52/311.1
2003/0145555 A1 * 8/2003 Raskin ..... E04C 3/06 52/844
2005/0115191 A1 * 6/2005 Owoc ..... B29C 63/18 52/831
2005/0120517 A1 * 6/2005 Bonham ..... E05D 5/06 16/238
2005/0183238 A1 * 8/2005 McCue ..... E05D 7/0027 16/236
2005/0252146 A1 * 11/2005 MacDonald ..... E04C 1/395 52/606
2006/0005355 A1 * 1/2006 Wallis ..... E05D 7/0027 16/237
2006/0010823 A1 * 1/2006 Waters ..... E04F 13/0733 52/834
2006/0010824 A1 * 1/2006 Waters ..... E04F 13/0733 52/834
2006/0016046 A1 * 1/2006 Koert ..... E05D 7/043 16/86.1
2006/0201087 A1 * 9/2006 Cutforth ..... E02D 27/16 52/296
2007/0101649 A1 * 5/2007 Anderson ..... E01F 13/048 49/49
2007/0266662 A1 * 11/2007 Oram ..... A47G 29/1216 52/311.1
2008/0006005 A1 * 1/2008 Bashour ..... E04G 21/1808 52/749.14
2008/0272353 A1 * 11/2008 Fattori ..... E04F 11/1812 256/19
2009/0120023 A1 * 5/2009 Hoggan ..... E04H 17/20 52/300
2009/0140228 A1 * 6/2009 Williams, Jr. ..... E05D 5/06 256/65.03
2010/0025650 A1 * 2/2010 Chung ..... E04H 17/1439 256/65.14
2010/0205901 A1 * 8/2010 Petta ..... E04C 3/30 52/831
2010/0223882 A1 * 9/2010 Parenti ..... E04C 3/36 52/834
2011/0030292 A1 * 2/2011 Oram ..... A47G 29/1216 52/173.1
2011/0197526 A1 * 8/2011 Thomas ..... E06B 11/02 52/296
2012/0279146 A1 * 11/2012 Thomas ..... E06B 11/02 52/126.1
2012/0324826 A1 * 12/2012 Petta ..... E04C 3/30 52/834
2013/0333308 A1 * 12/2013 Kumar ..... E04B 1/04 52/155
2015/0068084 A1 * 3/2015 Walters ..... G09F 7/18 40/607.03

* cited by examiner

PILLAR ASSEMBLY

BACKGROUND

This disclosure generally relates to a pillar assembly, and more particularly to a pillar assembly that can be formed of various panels that can be shipped in an efficient manner. This disclosure also relates to a pillar assembly having a reinforcement member for supporting the weight of a fence or a gate.

Pillars are used to support fences and gates. The pillars may be constructed of various materials such as wood, concrete, metal, fiberglass, or plastic. One known pillar assembly is an adjustable and reversible pillar assembly that is adapted to rest on a base. The assembly is a reversible substantially rectangular parallelepiped pillar housing resting on a base. The housing has opposite first and second ends which are substantially mirror images of one another. The first and second ends having corresponding first and second mounting flanges extending there around. The assembly is hollow, having a cavity therein defined by pillar walls extending longitudinally between the first and second ends of the pillar. The mounting flanges each extend inwardly of the walls and into the cavity. Either of the first or seconds ends is adapted for mounting on the base. One of the housing walls of the assembly is selectively removable from the assembly to provide access into the cavity when removed from the assembly. The base has substantially parallel upper and lower surfaces. The upper surface of the base is sized to mate with the first or second ends of the pillar assembly by mounting of the corresponding first or second mounting flanges onto the upper surface of base. Vertically adjustable feet are mounted to the lower surface of the base. The mounting flanges each have a plurality of mounting holes and the base has a corresponding plurality of ground anchor holes spaced around the base so as to cooperate with the plurality of mounting holes for receiving ground anchors for securing the pillar assembly onto the base and the base down onto the ground surface. The pillar assembly also has a vertically adjustable hinge mounting assembly that is mounted to or formed in one of the panels and the hinge mounting assembly may have a fence or a gate mounted thereon.

As can be appreciated, such a pillar assembly must be constructed of a heavy gauge metal in order to be strong enough to support a gate or a fence. Further, the pillar assembly must be strong enough to counteract the bending moment imparted to the pillar assembly by the cantilevered weight of the gate acting on the pillar assembly so as not to pull the pillar out of vertical alignment. One problem associated with such a pillar assembly is that the heavy gauge metal needed unnecessarily increases the cost of the assembly. Another problem associated with such a pillar assembly is that the heavy weight of the assembly makes shipping of the assembly very costly. Also, the heavy weight of the assembly requires more labor in unpacking the assembly, assembling the pillar assembly, and installing the assembly. All of these items add to the cost of manufacturing, shipping, and installing the pillar assembly which may lead to a decline in sales of the pillar assembly. Also, if a lighter gauge metal is used in the construction of a pillar assembly other problems may be encountered. One problem is that when transporting the known pillar assembly the weight of the assembly may bend, deform, or damage one or more of the walls. This should be avoided in that a new assembly will be required if one or more walls are damaged in this manner. Also, the lighter gauge metal may not be strong enough to support a gate or a fence. The weight of the gate may pull the pillar assembly out of alignment. If this occurs then the pillar assembly may have to be replaced or the alignment corrected. This may be difficult and time consuming and should be avoided.

The present disclosure is designed to obviate and overcome many of the disadvantages and shortcomings experienced with prior pillar assemblies. Moreover, the present disclosure is related to a pillar assembly that may be constructed having various panels so that the pillar assembly may be transported in a knocked down form. It would also be beneficial to have a pillar assembly having a reinforcement member that is capable of supporting a gate or a fence mounted thereto. Also, it would be advantageous to have a pillar assembly having a reinforcement member that uses a lighter weight gauge of metal to reduce manufacturing costs, shipping costs, installation costs, and maintenance costs.

SUMMARY

The present disclosure is directed to a pillar assembly which comprises a first side member, a second side member for connecting to the first side member, a third side member having a first side channel, a second side channel, and an access opening, the third side member for connecting to the second side member, and a fourth side member having an adjustment opening, the fourth side member for connecting to the first side member and the third side member.

In another embodiment of the present disclosure a pillar assembly comprises a first side member, a second side member for connecting to the first side member, a third side member having a first side channel, a second side channel, and an access opening, the third side member for connecting to the second side member, a fourth side member having an adjustment opening, the fourth side member for connecting to the first side member and the third side member, and a reinforcement member for fitting within the first side channel and the second side channel of the third side member for providing reinforcement for the third side member.

In yet another embodiment, a pillar assembly comprises a first side member, a second side member for connecting to the first side member, a third side member having a first side channel, a second side channel, and an access opening, the third side member for connecting to the second side member, a fourth side member having an adjustment opening, the fourth side member for connecting to the first side member and the third side member, and an access panel member for covering the access opening of the third side member.

In light of the foregoing comments, it will be recognized that the present disclosure is directed to a pillar assembly that may be constructed of various panels so that the pillar assembly may be transported in a knocked down form.

The present disclosure is directed to a pillar assembly that may be constructed of various panels so that the panel assembly may be easily assembled at an installation site.

The present disclosure is also directed to a pillar assembly that may be constructed of various panels that can be easily employed with highly reliable results that is capable of supporting a gate or a fence.

The present disclosure provides a pillar assembly that may be used to support a gate or a fence.

The present disclosure also provides a pillar assembly that is adjustable to level a gate or a fence relative to the pillar assembly The present disclosure further provides a pillar assembly having a reinforcement member that is adjustable to level a gate or a fence relative to the pillar assembly.

The present disclosure provides a pillar assembly having a reinforcement member that is easy to use and operate and does not require any advanced or special training or special tools to assemble and adjust the pillar assembly having a reinforcement member.

The present disclosure provides a pillar assembly having a reinforcement member that may be transported in a knocked down state for transportation of the pillar assembly having a reinforcement member and may be easily assembled at the destination of the pillar assembly having a reinforcement member.

The present disclosure is also directed to a pillar assembly having a reinforcement member that can be shipped, stored, and retailed in a compact form.

The present disclosure further provides a pillar assembly having a reinforcement member that can be constructed using thinner material and still be able to have a heavy gate attached thereto.

The present disclosure is also directed to a pillar assembly having a reinforcement member that can be constructed using thinner material and still be shipped without being damaged during shipping or transportation to an installation site.

The present disclosure is further directed to a pillar assembly having a reinforcement member that is capable of supporting a gate or a fence and prevents misalignment of the pillar assembly in a vertical direction.

The present disclosure provides a pillar assembly having a reinforcement member that is capable of housing and supporting a number of hinge assemblies to be connected to a gate.

The present disclosure is also directed to a pillar assembly having a reinforcement member that may enclose a semi-automatic gate opener mechanism within the pillar assembly to protect the semi-automatic gate opener mechanism from the elements.

The present disclosure provides a pillar assembly that may enclosed various components such as lighting and electrical connections to protect the various components from being tampered with and from the elements.

The present disclosure further provides a pillar assembly that may be used to support various portions of a fence.

These and other advantages of the present disclosure will become apparent to those skilled in the art after considering the following detailed specification in conjunction with the accompanying drawings.

DETAILED DESCRIPTION OF PREFERRED EMBODIMENTS

Figure 1:
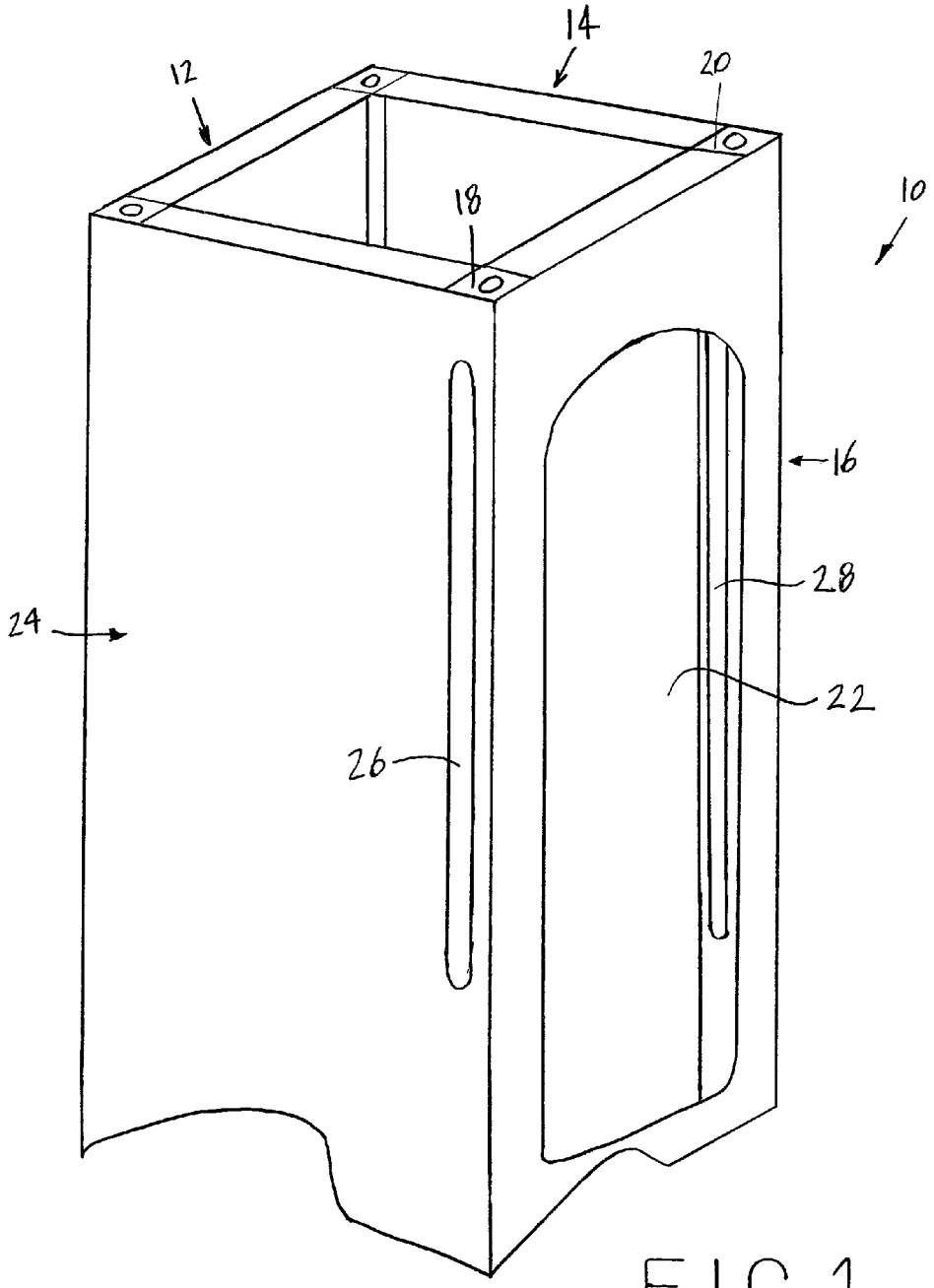
FIG. 1 is a partial perspective view of a pillar assembly constructed according to the present disclosure.

Referring now to the drawings, wherein like numbers refer to like items, number 10 identifies a preferred embodiment of a pillar assembly constructed according to the present disclosure. With reference now to FIG. 1, the pillar assembly 10 is shown comprising a first side member 12, a second side member 14, a third side member 16 having a first side channel 18, a second side channel 20, and an upper access opening 22, and a fourth side member 24 having an upper adjustment opening 26. The second side member 14 also has an upper adjustment opening 28. As can be appreciated, the pillar assembly 10 comprises the side members 12, 14, 16, and 24 that can be connected together to form the assembly 10. Due to this, the pillar assembly 10 may be packed in a knocked down form or state to be shipped or transported in an efficient manner.

Figure 2:
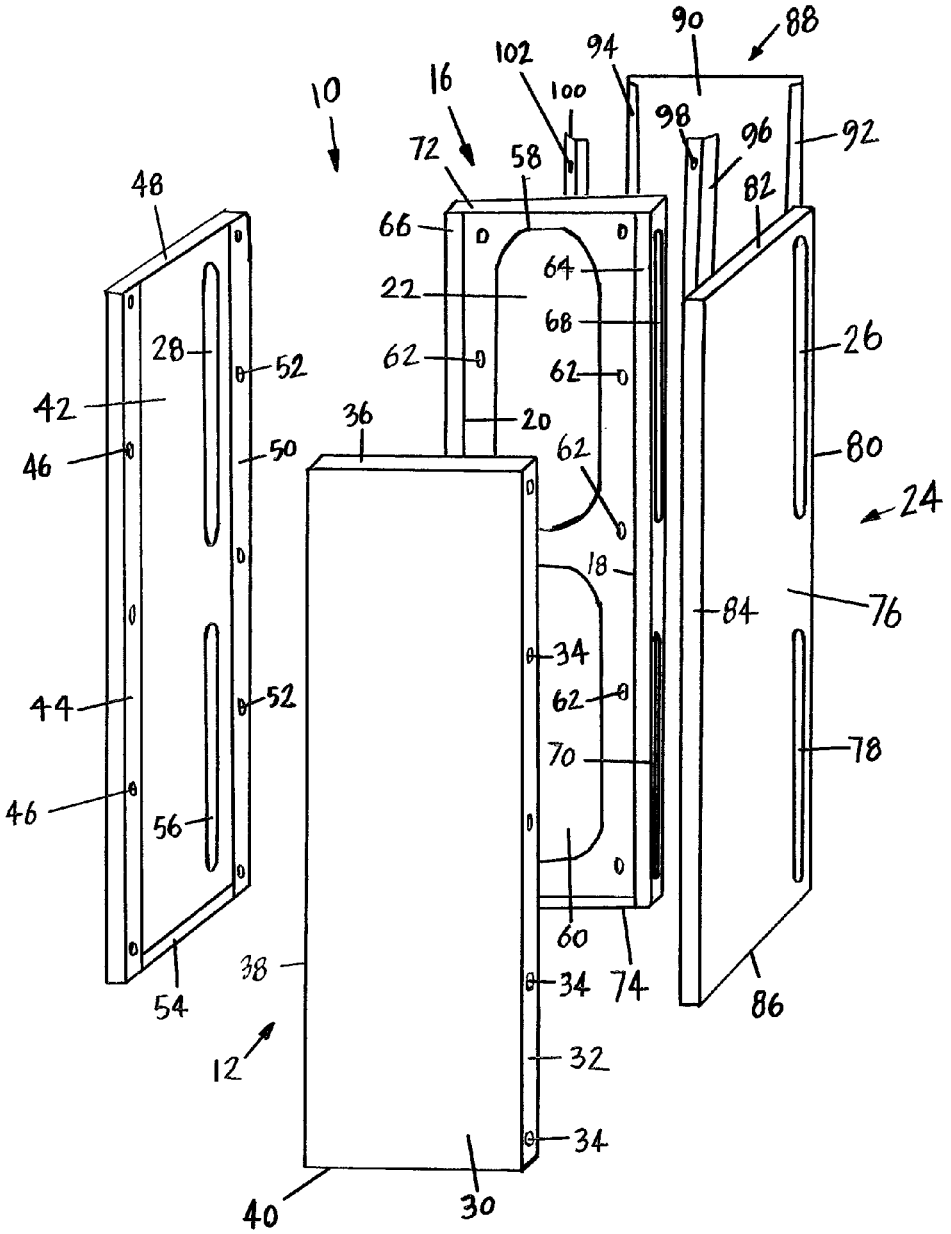
FIG. 2 is an exploded perspective view of the pillar assembly shown in FIG. 1 constructed according to the present disclosure.

Referring now to FIG. 2, an exploded view of the pillar assembly 10 is shown. The first side member 12 has a generally rectangular front side 30, a first side flange 32 having a plurality of apertures 34, a top flange 36, a second side flange 38, and a bottom flange 40. Although not shown in this particular view, the flanges 36, 38, and 40 may also have apertures formed therein. The second side member 14 has a generally rectangular back side 42, a first side flange 44 having a plurality of apertures 46, a top flange 48, a second side flange 50 having a plurality of apertures 52, and a bottom flange 54. A plurality of apertures may be formed in the top flange 48 and the bottom flange 54, however, such apertures are not shown in this drawing figure. As can be appreciated, the apertures (not shown) formed in the second side flange 38 of the first side member 12 may have a bolt, screw, or other suitable fastening member inserted there through to be inserted through the apertures 46 of the first side flange 44 of the second side member 14 to connect the side members 12 and 14 together. The back side 42 also has the upper adjustment opening 28 and a lower adjustment opening 56 formed therein.

The third side member 16 has a generally rectangular back side 58 having the upper access opening 22, a lower access opening 60, and a plurality of apertures 62. The third side member 16 also has a first side flange 64 which forms the first side channel 18 and a second side flange 66 which forms the second side channel 20. The first side flange 64 also has an upper adjustment opening 68 and a lower adjustment opening 70. The third side member 16 further has a top flange 72 and a bottom flange 74. Although not shown, the flanges 72 and 74 may have apertures formed therein for receiving connecting members or devices. Although not visible in this particular view, the second side flange 66 has an upper adjustment opening and a lower adjustment opening formed therein. These adjustment openings align with the upper adjustment opening 28 and the lower adjustment opening 56 of the second side member 14. The fourth side member 24 has a generally rectangular front side 76 having the upper adjustment opening 26 and a lower adjustment opening 78 formed therein. The fourth side member 24 has a first side flange 80, a top flange 82, a second side flange 84, and a bottom flange 86. An access panel member 88 is also provided for covering the access openings 22 and 60 of the third side member 16. The access panel member 88 has a back side 90, a first side flange 92, and a second side flange 94. A first rail member 96 having a plurality of apertures 98 is provided to be attached to the third side member 16. A second rail member 100 having a plurality of apertures 102 is also provided to be attached to the third side member 16. The apertures 98 and 102 are aligned with the apertures 62 to attach or bolt the rail members 96 and 100 to the third side member 16. The rail members 96 and 100 are used to have have the side flanges 92 and 94 of the access panel member 88 slide thereon to capture and hold the access panel member 88. In this manner, the access panel member 88 covers the access openings 22 and 60 formed in the third side member 16.

Figure 3:
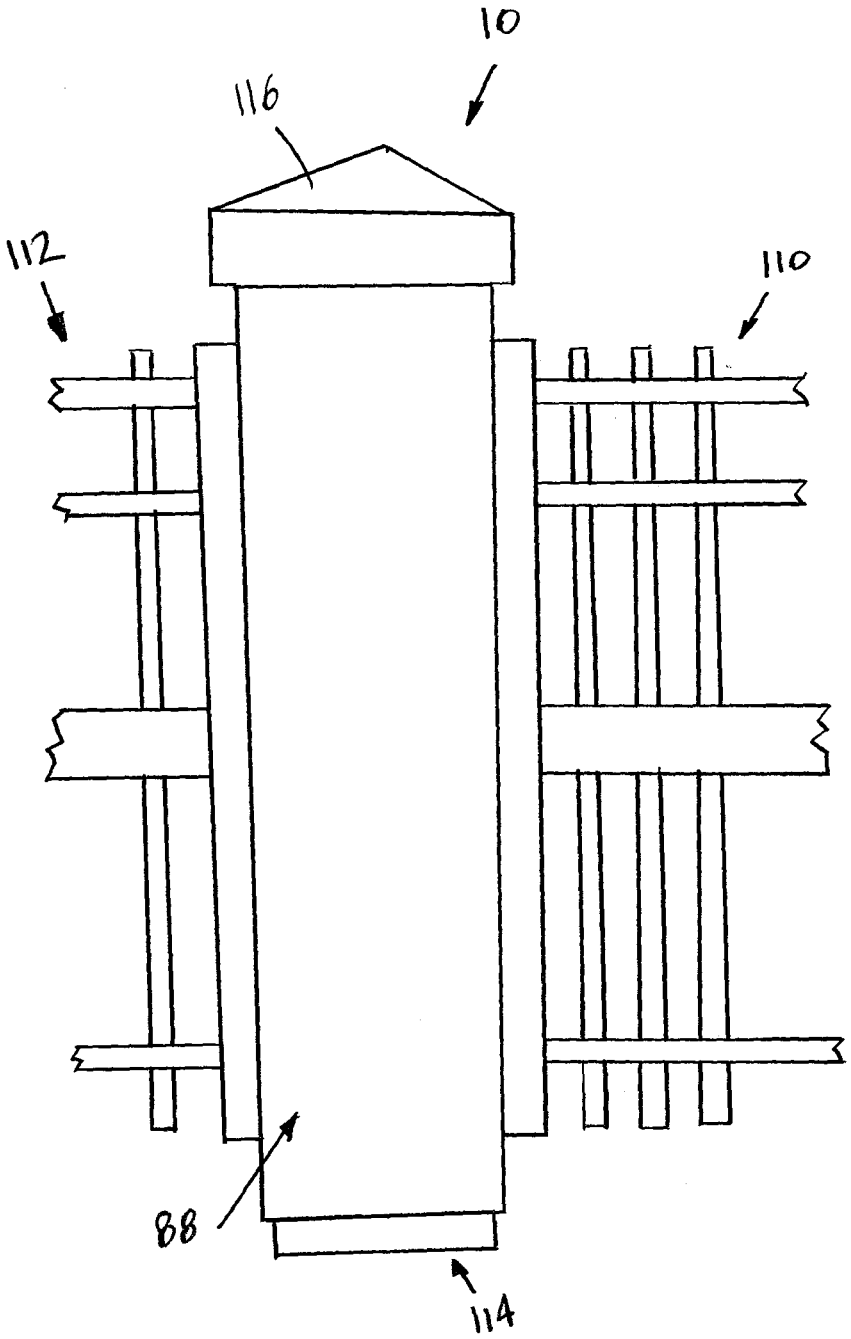
FIG. 3 is a perspective view of the pillar assembly shown in FIG. 1 having a pair of fences mounted thereto with the pair of fences being shown partially.

FIG. 3 is a perspective view of the pillar assembly 10 being connected between a first fence portion 110 and a second fence portion 112. A partial view of each of the fence portions 110 and 112 are illustrated in this particular drawing. The fence portions 110 and 112 are connected to the pillar assembly 10 through the use of the adjustment openings 26, 28, 56, and 78. For example, nuts and bolts may be positioned in the openings 26, 28, 56, and 78 to connect the assembly 10 to the fence portions 110 and 112. The pillar assembly 10 may be placed on a base assembly 114 that is used to horizontally adjust or level the pillar assembly 10 as needed. The pillar assembly 10 may also have a cap 116 that may be secured to the pillar assembly 10. The access panel member 88 is shown being installed in place to cover the access openings 22 and 78. The access panel member 88 acts as a decorative panel or side member to resemble the side member 12. The pillar assembly 10 may be placed between any number of fence portions 110 and 112 to form a fence, as required.

In order to install the pillar assembly 10, the ground where the assembly 10 is to be positioned may be excavated and concrete poured into the excavation to form a base or a pad upon which the assembly 10 will be placed. The first side member 12 is bolted or connected to the second side member 14. The third side member 16 is then bolted or connected to the second side member 14. The fourth side member 24 is then connected to the first side member 12 and the third side member 16. The rail members 96 and 100 may be connected to the third side member 16. The pillar assembly 10, at this point of installation, may then be placed on the poured concrete foundation and various measurements are taken to place the assembly 10 into the correct position. Anchor bolt locations are marked for drilling. The assembly 10 is removed from the concrete foundation and the anchor bolt holes are drilled. Washers or spacers may be placed over the anchor bolts to level the assembly 10 and space the assembly 10 up and away from any standing water on top of the concrete foundation. The anchor bolts may be inserted through apertures formed in the bottom flanges 40, 54, 74, and 86 and into the anchor bolt holes to bolt the assembly 10 in place. Alternatively, it is also possible and contemplated that the base assembly 114 may be connected by use of the anchor bolts and the pillar assembly 10 may then be connected to the base assembly 114. The fence portions 110 and 112 may be connected to the pillar assembly 10 through the use of the adjustment openings 26, 28, 56, and 78. The access panel member 88 is then installed on the rail members 96 and 100 to cover the access openings 22 and 60. The cap 116 may then be placed on the pillar assembly 10. Slot covers (not shown) may be used to cover the openings 26, 28, 56, and 78, if needed.

The pillar assembly 10 may be shipped or transported in a knocked down form or flat configuration. The side members 12, 14, 16, and 24 can be placed on top of each other to be able to ship the members 12, 14, 16, and 24 in a compact form or bundle. The bundle of side members 12, 14, 16, and 24 may be placed in an efficiently sized box and can therefor be shipped at a lower cost. As has been discussed above, the side members 12, 14, 16, and 24 can then be assembled by an end user, an installer, or a contractor on site to form the pillar assembly having a reinforcement member 10. The pillar assembly 10 will have sufficient structural integrity to support and swing a gate or to have a decorative fence panel attached thereto. The side members 12, 14, 16, and 24 are engineered such that the thickness of the metal in key areas is reinforced.

Figure 4:
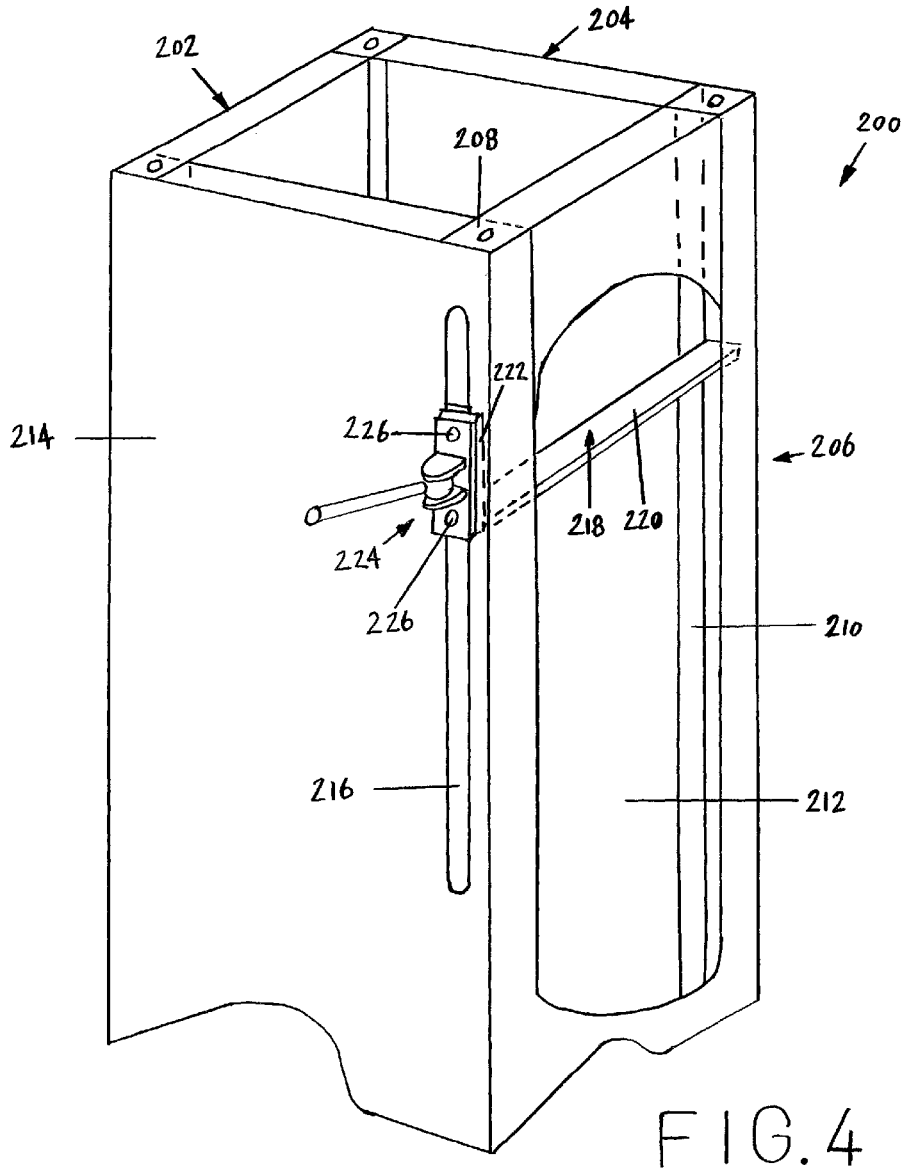
FIG. 4 is a partial perspective view of another preferred embodiment of a pillar assembly constructed according to the present disclosure.

With reference now to FIG. 4, another preferred embodiment a pillar assembly 200 is shown comprising a first side member 202, a second side member 204, a third side member 206 having a first side channel 208, a second side channel 210, and an upper access opening 212, a fourth side member 214 having an upper adjustment opening 216, and a reinforcement member 218 for fitting within the first side channel 208 and the second side channel 210 of the third side member 206 for providing reinforcement for the third side member 206. The reinforcement member 218 has a first leg 220 that spans across the third side member 206 and a second leg 222 that is attached to a hinge assembly 224 by use of bolts 226. The reinforcement member 218 and the hinge assembly 224 may be adjusted as need be by moving the member 218 and the assembly 224 up or down within the adjustment opening 216.

Figure 5:
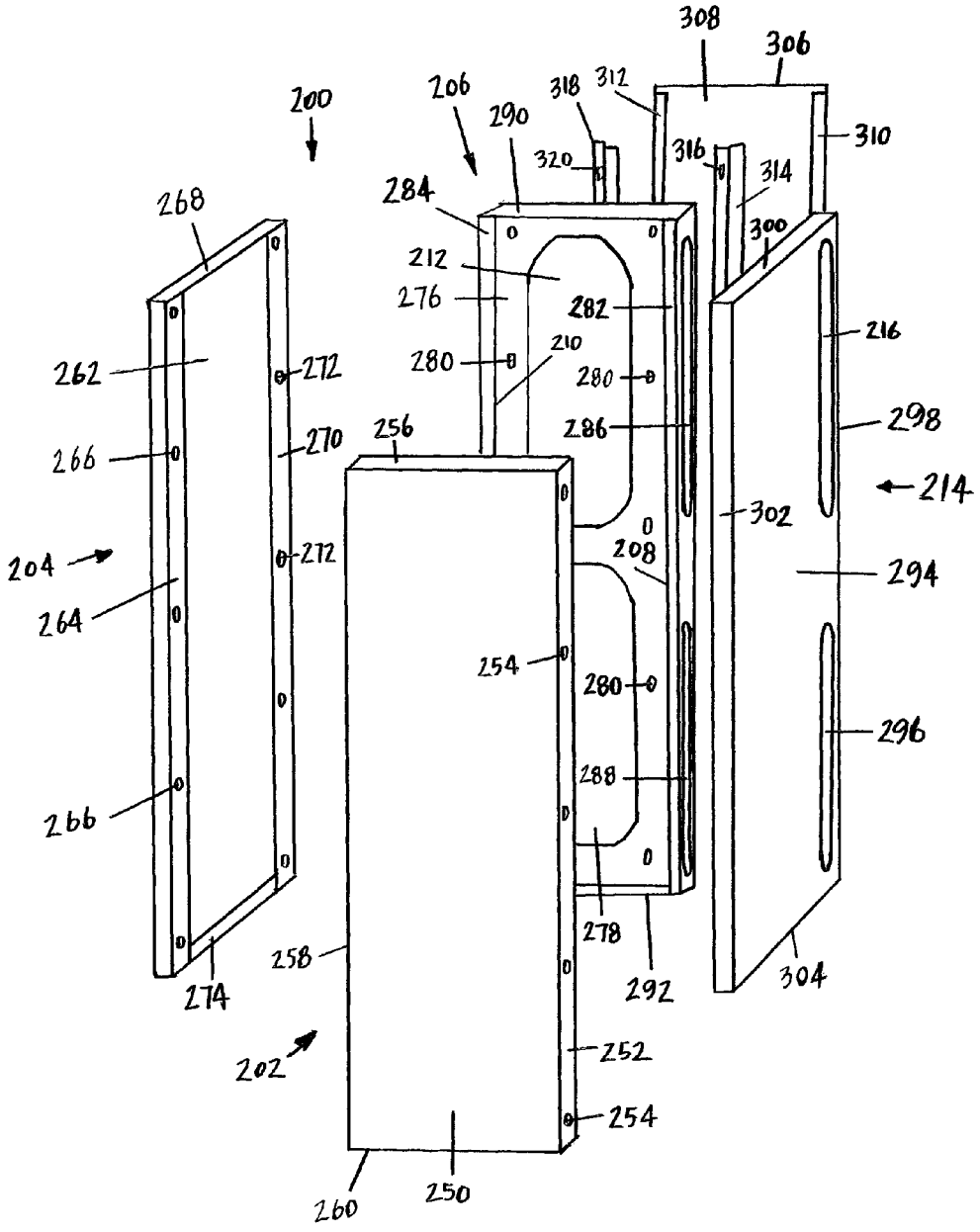
FIG. 5 is an exploded perspective view of the pillar assembly shown in FIG. 3 constructed according to the present disclosure.

Referring now to FIG. 5, an exploded view of the pillar assembly having a reinforcement member 200 is shown. The first side member 202 has a generally rectangular front side 250, a first side flange 252 having a plurality of apertures 254, a top flange 256, a second side flange 258, and a bottom flange 260. Although not shown in this particular view, the flanges 256, 258, and 260 may also have apertures formed therein. The second side member has a generally rectangular back side 262, a first side flange 264 having a plurality of apertures 266, a top flange 268, a second side flange 270 having a plurality of apertures 272, and a bottom flange 274. A plurality of apertures may be formed in the top flange 268 and the bottom flange 274, however, such apertures are not shown in this drawing figure. As can be appreciated, the apertures (not shown) formed in the second side flange 258 of the first side member 202 may have a bolt, screw, or other suitable fastening member inserted there through to be inserted through the apertures 266 of the first side flange 264 of the second side member 204 to connect the side members 202 and 204 together.

The third side member 206 has a generally rectangular back side 276 having the upper access opening 212 a lower access opening 278, and a plurality of apertures 280. The third side member 206 also has a first side flange 282 which forms the first side channel 208 and a second side flange 284 which forms the second side channel 210. The first side flange 284 also has an upper adjustment opening 286 and a lower adjustment opening 288. The third side member 206 further has a top flange 290 and a bottom flange 292. Although not shown, the flanges 290 and 292 may have apertures formed therein for receiving connecting members or devices. The fourth side member 214 has a generally rectangular front side 294 having the upper adjustment opening 216 and a lower adjustment opening 296 formed therein. The fourth side member 214 has a first side flange 298, a top flange 300, a second side flange 302, and a bottom flange 304. An access panel member 306 is also provided for covering the access openings 212 and 278 of the third side member 206. The access panel member 306 has a back side 308, a first side flange 310, and a second side flange 312. A first rail member 314 having a plurality of apertures 316 is provided to be attached to the third side member 206. A second rail member 318 having a plurality of apertures 320 is also provided to be attached to the third side member 206. The apertures 316 and 320 are aligned with the apertures 280 to attach or bolt the rail members 314 and 318 to the third side member 206. The rail members 314 and 318 are used to have the side flanges 310 and 312 of the access panel member 306 slide thereon to capture and hold the access panel member 306. In this manner, the access panel member 306 covers the access openings 212 and 278 formed in the third side member 206. It is also contemplated that the second side member 204 can be the same as the second side member 14 shown in FIG. 2 in that the second side member 204 may also have an upper adjustment opening and a lower adjustment opening. It is further possible that the second channel 210 may have an upper adjustment opening and a lower adjustment opening to be aligned with the adjustment openings formed in the second side member 204.

Figure 6:
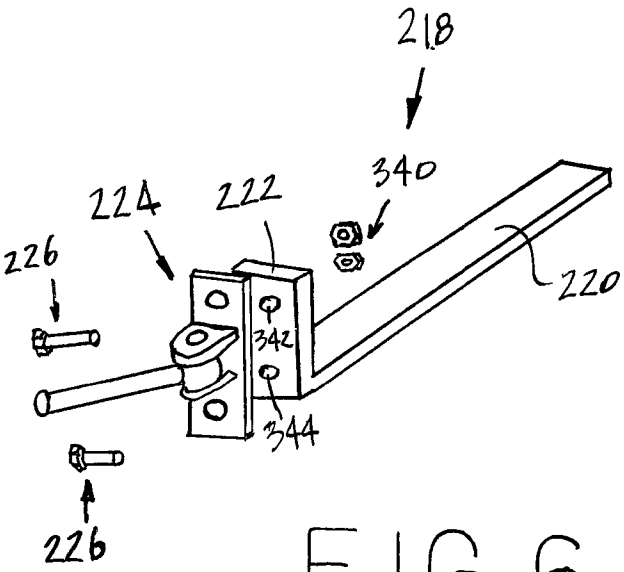
FIG. 6 is an exploded view of a reinforcement member, a hinge assembly, and connecting devices.

FIG. 6 illustrates an exploded view of the reinforcement member 218, the hinge assembly 224, the bolts 226, and a pair of nuts 340. The reinforcement member 218 has the first leg 220 and the second leg 222 that has a pair of apertures 342 and 344. The apertures 342 and 344 are used to receive the pair of bolts 226. The nuts 340 are threaded onto the bolts 226 to secure the reinforcement member 218 and the hinge assembly 224 together. By loosening the nuts 342 and 344, the reinforcement member 218 and the hinge assembly 224 may be adjusted upward or downward within the upper adjustment openings 216 and 286. The reinforcement member 218 may be constructed of any suitable material such as steel, metal, iron, or any alloy or combinations of materials. The purpose of the reinforcement member 218 being to strengthen the third side member 206 during packaging, shipping, and installation so that a lighter or thinner material may be used to form the third side member 206. Although one reinforcement member 218 has been shown and discussed, it is also possible and contemplated that a second reinforcement member or multiple reinforcement members may be used to further reinforce the third side member 206. For example, the second reinforcement member may be inserted into the first channel 208 and the second channel 210 and another hinge assembly may be connected or bolted to the second reinforcement member through the lower opening 88 in the third side member 206 and the lower opening 296 in the fourth side member 214.

Figure 7:
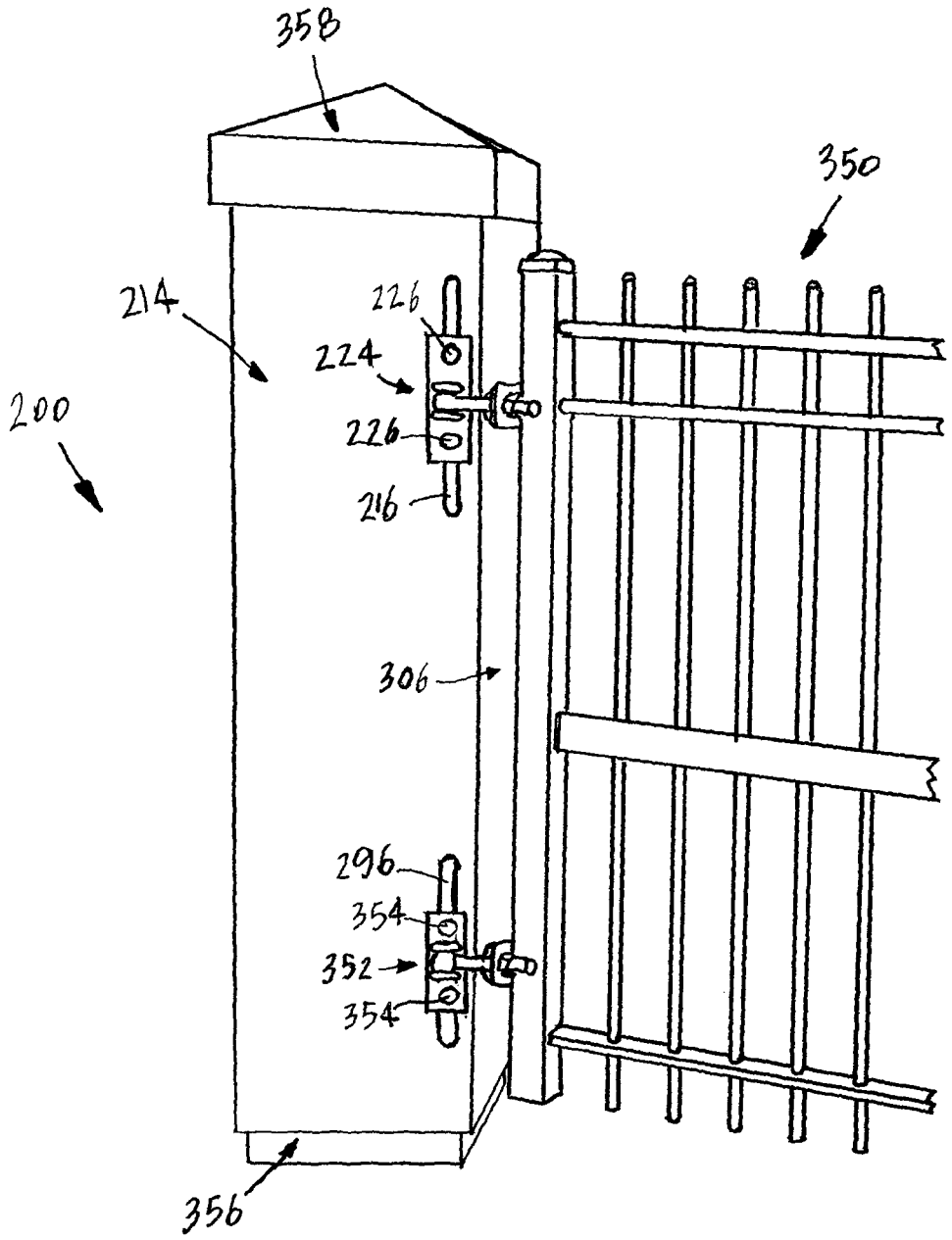
FIG. 7 is a front perspective view of the pillar assembly shown in FIG. 3 having a gate mounted thereto with a partial view of the gate being shown.

With particular reference now to FIG. 7, a front perspective view of the pillar assembly having a reinforcement member 200 being connected to a gate 350 is shown. A partial view of the gate 350 is illustrated in this particular drawing. The gate 350 is connected to the hinge assembly 224 and to a second hinge assembly 352. The hinge assembly 224 is connected to the reinforcement member 218 (not shown) by use of the bolts 226. The hinge assembly 224 is adjustable within the upper adjustment opening 216. The second hinge assembly 352 may be connected to another reinforcement member (not shown) by use of the pair of bolts 354. The second hinge assembly 352 is adjustable within the lower adjustment opening 296. The pillar assembly 200 may be placed on a base assembly 356 that is used to horizontal adjust or level the pillar assembly 200 as needed. The pillar assembly 200 may also have a cap 358 that may be secured to the pillar assembly 200. The access panel member 306 is shown being installed in place to cover the access openings 212 and 278. The access panel member 306 acts as a decorative panel or side member to resemble the side members 202 and 204.

During installation of the pillar assembly 200, the ground where the assembly 200 is to be positioned may be excavated and concrete poured into the excavation to form a base or a pad upon which the assembly 200 will be placed. The first side member 202 is bolted or connected to the second side member 204. The third side member 206 is then bolted or connected to the second side member 204. The fourth side member 214 is then connected to the first side member 202 and the third side member 206. The reinforcement member 218 is placed into the channels 208 and 210 and the hinge assembly 224 is bolted or connected to the reinforcement member 218. By use of the bolts 226, the reinforcement member 218 and the hinge assembly 224 may be adjusted within the openings 216 and 296. The second hinge assembly 352 may be bolted or connected to another reinforcement member by use of the bolts 354. The second hinge assembly 352 may be adjusted within the openings 288 and 296. The rail members 314 and 318 may be connected to the third side member 206. The pillar assembly 200, at this point of installation, may then be placed on the poured concrete foundation and various measurements are taken to place the assembly 200 into the correct position. Anchor bolt locations are marked for drilling. The assembly 200 is removed from the concrete foundation and the anchor bolt holes are drilled. Washers or spacers may be placed over the anchor bolts to level the assembly 200 and space the assembly 200 up and away from any standing water on top of the concrete foundation. The anchor bolts may be inserted through apertures formed in the bottom flanges 260, 274, 292, and 304 and into the anchor bolt holes to bolt the assembly 200 in place. Alternatively, it is also possible and contemplated that the base assembly 356 may be connected by use of the anchor bolts and the pillar assembly 200 may then be connected to the base assembly 356. Any other hardware, such as a gate actuator, lighting components, or electrical components may be installed at this time. The access panel member 306 is then installed on the rail members 314 and 318 to cover the access openings 212 and 278. The cap 358 may then be placed on the pillar assembly 200. The gate 350 may then be connected to the hinge assemblies 224 and 352. Slot covers (not shown) may be used to cover the openings 216 and 296. The slot covers may be measured and cut to length prior to being inserted into the openings 216 and 296. The slot covers may be held in place by the hinge assemblies 224 and 352.

The pillar assembly 200 may be shipped or transported in a knocked down form or flat configuration. The side members 202, 204, 206, and 214 can be placed on top of each other to be able to ship the members 202, 204, 206, and 214 in a compact form or bundle. The bundle of side members 202, 204, 206, and 214 may be placed in an efficiently sized box and can therefor be shipped at a lower cost. As has been discussed above, the side members 202, 204, 206, and 214 can then be assembled by an end user, an installer, or a contractor on site to form the pillar assembly having a reinforcement member 200. The pillar assembly 200 will have sufficient structural integrity to support and swing a gate or to have a decorative fence panel attached thereto. The side members 202, 204, 206, and 214 are engineered such that the thickness of the metal in key areas is reinforced. Further, the reinforcement member 218 is capable of transferring the torque from the hinge assembly 224 to the channel 210 formed in the third side member 206. The channels 208 and 210 also allow the reinforcement member 218 to be adjusted with any adjustment required of the hinge assembly 224. The reinforcement member 218 also transfers the force from the hinge assembly 224 to the channel 210 formed within the third side member.

From all that has been said, it will be clear that there has thus been shown and described herein a pillar assembly. It will become apparent to those skilled in the art, however, that many changes, modifications, variations, and other uses and applications of the subject pillar assembly are possible and contemplated. All changes, modifications, variations, and other uses and applications which do not depart from the spirit and scope of the disclosure are deemed to be covered by the disclosure, which is limited only by the claims which follow.

What is claimed is:

1. A pillar assembly comprising:

a first side member;

a second side member for connecting to the first side member;

a third side member having a first side channel having a first side channel adjustment opening, a second side channel, and an access opening, the third side member for connecting to the second side member;

a fourth side member having an adjustment opening for alignment with the first side channel adjustment opening, the fourth side member for connecting to the first side member and the third side member;

a reinforcement member for fitting within the first side channel and the second side channel of the third side member for providing reinforcement for the third side member, the reinforcement member comprising an L-shaped member having a first leg for spanning between the first side channel and the second side channel and a second leg; and a second reinforcement member for fitting within the first side channel and the second side channel of the third side member for providing reinforcement for the third side member.

2. The pillar assembly of claim 1 further comprising a hinge assembly for placement in the adjustment opening of the fourth side member.

3. The pillar assembly of claim 1 wherein the reinforcement member further comprises an aperture in the second leg adapted to receive a connecting device.

4. The pillar assembly of claim 1 wherein the fourth side member further comprises a second adjustment opening.

5. The pillar assembly of claim 4 wherein the second side channel of the third side member further comprises a second side channel adjustment opening for alignment with the adjustment opening of the fourth side member.

6. The pillar assembly of claim 5 wherein the second side member further comprises a second adjustment opening.

7. A pillar assembly comprising:

a first side member;

a second side member for connecting to the first side member;

a third side member having a first side channel, a second side channel, and an access opening, the third side member for connecting to the second side member;

a fourth side member having an adjustment opening, the fourth side member for connecting to the first side member and the third side member;

a reinforcement member for fitting within the first side channel and the second side channel of the third side member for providing reinforcement for the third side member, the reinforcement member comprising an L-shaped member having a first leg for spanning between the first side channel and the second side channel and a second leg, the reinforcement member is movable within the first channel, the second channel, and the adjustment opening.

8. The pillar assembly of claim 7 wherein the reinforcement member further comprises a pair of apertures in the second leg for receiving a pair of connecting devices for attaching a hinge assembly.

9. The pillar assembly of claim 7 wherein the reinforcement member further comprises an aperture in the second leg adapted to receive a connecting device.

10. The pillar assembly of claim 7 wherein the fourth side member further comprises an access opening.

11. The pillar assembly of claim 7 wherein the fourth side member further comprises a second adjustment opening.

12. A pillar assembly comprising:

a first side member;

a second side member for connecting to the first side member;

a third side member having a first side channel, a second side channel, and an access opening, the third side member for connecting to the second side member;

a fourth side member having an adjustment opening, the fourth side member for connecting to the first side member and the third side member;

an access panel member for covering the access opening of the third side member, the access panel further comprising a first side flange and a second side flange with the pillar assembly further comprising a pair of rail members with the first side flange and the second side flange for sliding on the rail members for the access panel member to be held in place to cover the access panel member;

a reinforcement member for fitting within the first side channel and the second side channel of the third side member for providing reinforcement for the third side member, the reinforcement member comprises an L-shaped member having a first leg for spanning between the first side channel and the second side channel and a second leg; and a second reinforcement member for fitting within the first side channel and the second side channel of the third side member for providing reinforcement for the third side member.

13. The pillar assembly of claim 12 wherein the reinforcement member further comprises an aperture in the second leg adapted to receive a connecting device.

14. The pillar assembly of claim 12 wherein the fourth side member further comprises a second adjustment opening.

* * * * *